US005350143A

United States Patent [19]

Hoshino

[11] Patent Number: 5,350,143

[45] Date of Patent: Sep. 27, 1994

[54] COLLAPSIBLE STAND FOR GUITARS OR THE LIKE

[75] Inventor: Yoshiki Hoshino, Aichi, Japan

[73] Assignee: Hoshino Gakki Co., Ltd., Japan

[21] Appl. No.: 975,794

[22] Filed: Nov. 13, 1992

[30] Foreign Application Priority Data

Feb. 26, 1992 [JP] Japan ..... 4-018391[U]

[51] Int. Cl.[5] ..... G10D 3/00

[52] U.S. Cl. ..... 248/166; 84/327; 248/460

[58] Field of Search ..... 248/431, 121, 164, 166, 248/170, 168, 465, 460, 461; 84/327, 329, 453, 280 R, 280 C

[56] References Cited

U.S. PATENT DOCUMENTS

| | | | |
|---|---|---|---|
| 1,611,035 | 12/1926 | Hovasse | 248/166 X |
| 1,612,148 | 12/1926 | Oettinger | 248/166 X |
| 1,673,205 | 6/1928 | Romao | 248/166 X |
| 1,684,912 | 9/1928 | Dunklau | 84/327 X |
| 2,517,896 | 8/1950 | Lawrence | 84/453 |
| 4,582,282 | 4/1986 | Gracie . | |
| 5,165,631 | 11/1992 | Norsworthy | 248/121 |

FOREIGN PATENT DOCUMENTS

| | | | |
|---|---|---|---|
| 444408 | 2/1968 | Switzerland | 248/465 |

*Primary Examiner*—Karen J. Chotkowski

*Attorney, Agent, or Firm*—Ostrolenk, Faber, Gerb & Soffen

[57] ABSTRACT

A collapsible stand for use in supporting a guitar or another object. The stand includes a top main member, a central leg which is pivotable forwardly and rearwardly of the main member. In the forward position, the central leg is in a supporting position. Right and left side legs are provided to the right and left of the central leg and the side legs are pivotable outwardly away from the central leg and inwardly toward the central leg. The left and right side legs each include a supporting part thereon, e.g., for supporting a guitar. In particular, the left and right side legs are L shaped, and their bottom forwardly projecting parts would support a guitar. The extent of opening apart of the left and right side legs and the extent of rearward movement of the central leg when the legs are opened apart is restricted by the shape of the main member which the legs engage. The legs are so shaped that the central leg fits approximately between the left and right side legs when all of the legs are pivoted to each other to collapse the stand.

11 Claims, 4 Drawing Sheets

FIG. 4
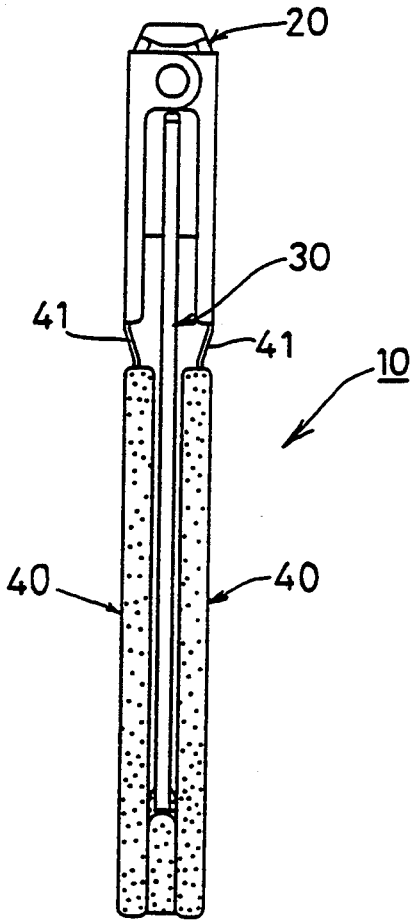
FIG. 3
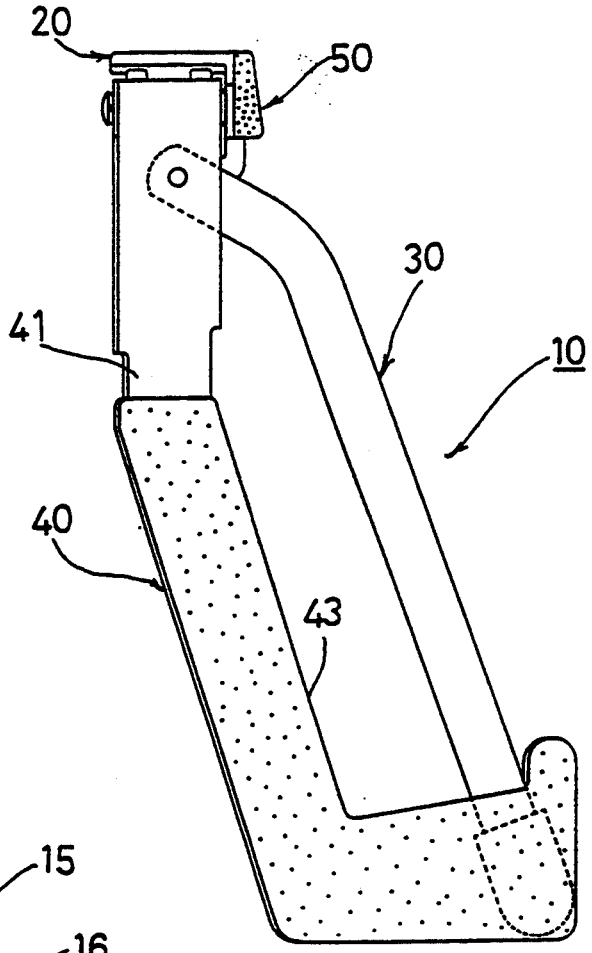
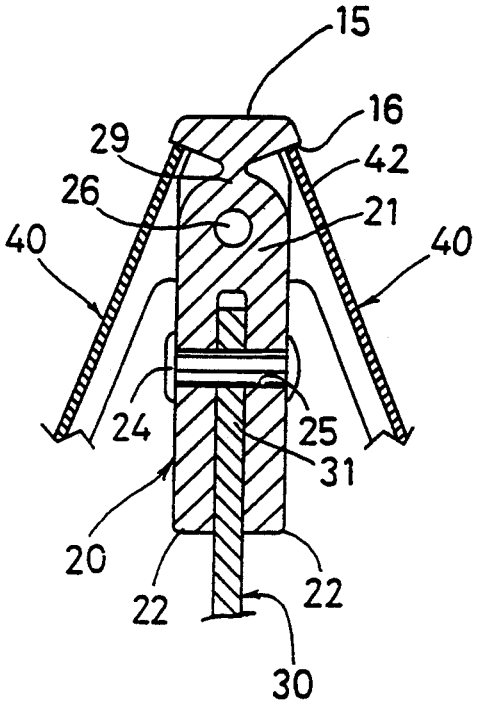
FIG. 5

COLLAPSIBLE STAND FOR GUITARS OR THE LIKE

BACKGROUND OF THE INVENTION

The present invention relates to a collapsible support stand, and particularly a guitar stand.

Stands are employed for upright support of objects, including musical instruments, such as a guitar, which objects and instruments do not have a self supporting character.

When a musical performance is given outside a regular music performance studio, e.g. outdoors, as in a park, or is conducted in a small studio or even a garage, etc. which has no instrument support provision for a stand, the guitar or other instrument is typically leaned against a wall of a structure or of an amplifier since it is bothersome for a guitar player to carry around a stand for the instrument.

However, the guitar or other instrument lacks stability, e.g., when it is stood on an edge or an end, and it may tip over or fall of its own weight or someone may stumble over it, thereby damaging the guitar or other instrument.

SUMMARY OF THE INVENTION

Hereafter, the stand of the invention is described in connection with supporting a guitar. But it is to be understood that the inventive stand can be used to support other objects.

The object of the present invention is to support a guitar or other object in a stable manner.

Another object is to provide a compactly collapsible stand.

Another object of the invention is to provide a collapsible guitar stand which remains stable when a guitar is leaned against it and which can be conveniently carried around.

The collapsible guitar stand comprises a main member which has attached to it a central leg and right and left legs at opposite sides of the central leg. Each of the right and left legs includes a guitar holding part, which may be approximately in the shape of an L, that opens to the front. The central leg is freely pivotably fixed at its top to the main member for movement forward and rearward. The right and left legs are also freely pivotably mounted to be opened apart and closed together to the right and to the left of the central leg.

Other objects and features of the present invention are described with reference to the accompanying drawings.

BRIEF DESCRIPTION OF THE DRAWINGS

FIG. 3 is a side view in the collapsed state;

FIG. 4 is a rear view in the collapsed state;

FIG. 5 is a cross section along line 5—5 of FIG. 1;

DESCRIPTION OF A PREFERRED EMBODIMENT

Figure 1:
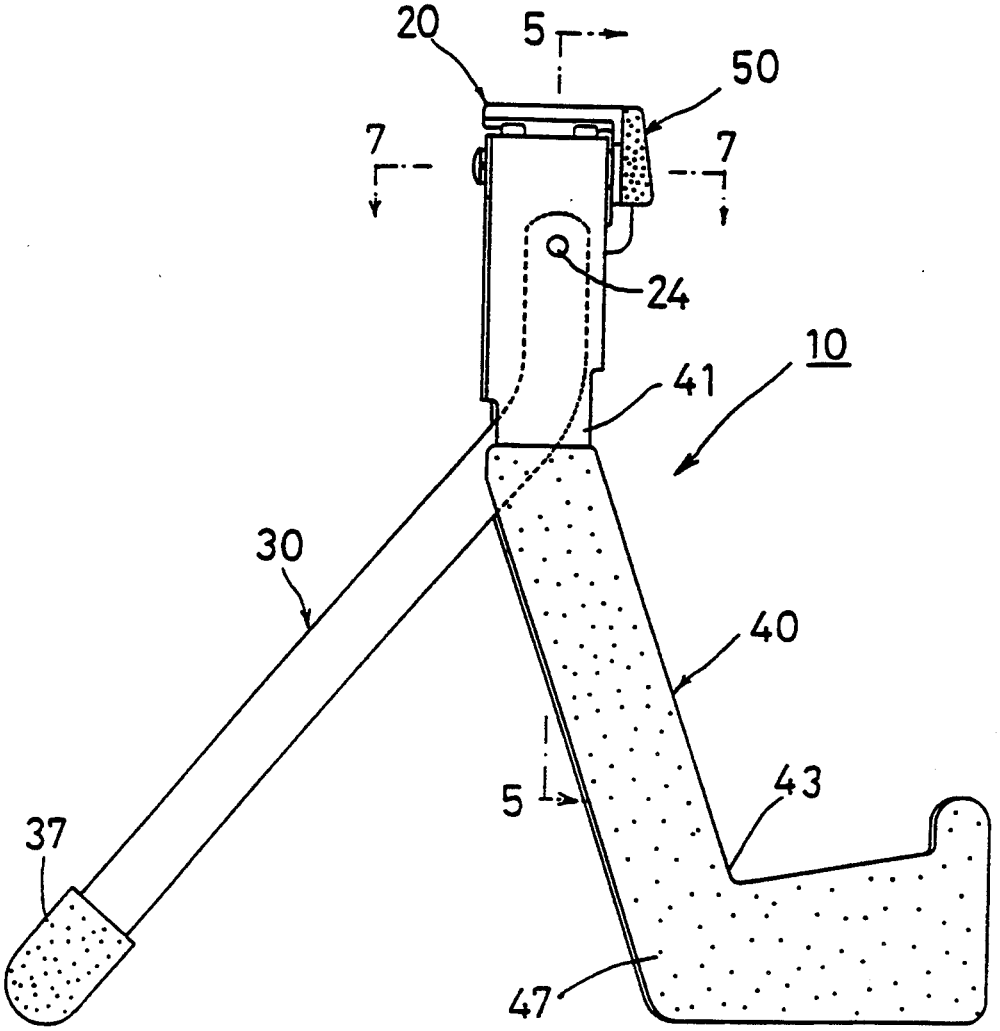
FIG. 1 is a side view of a guitar stand of the invention.
Figure 2:
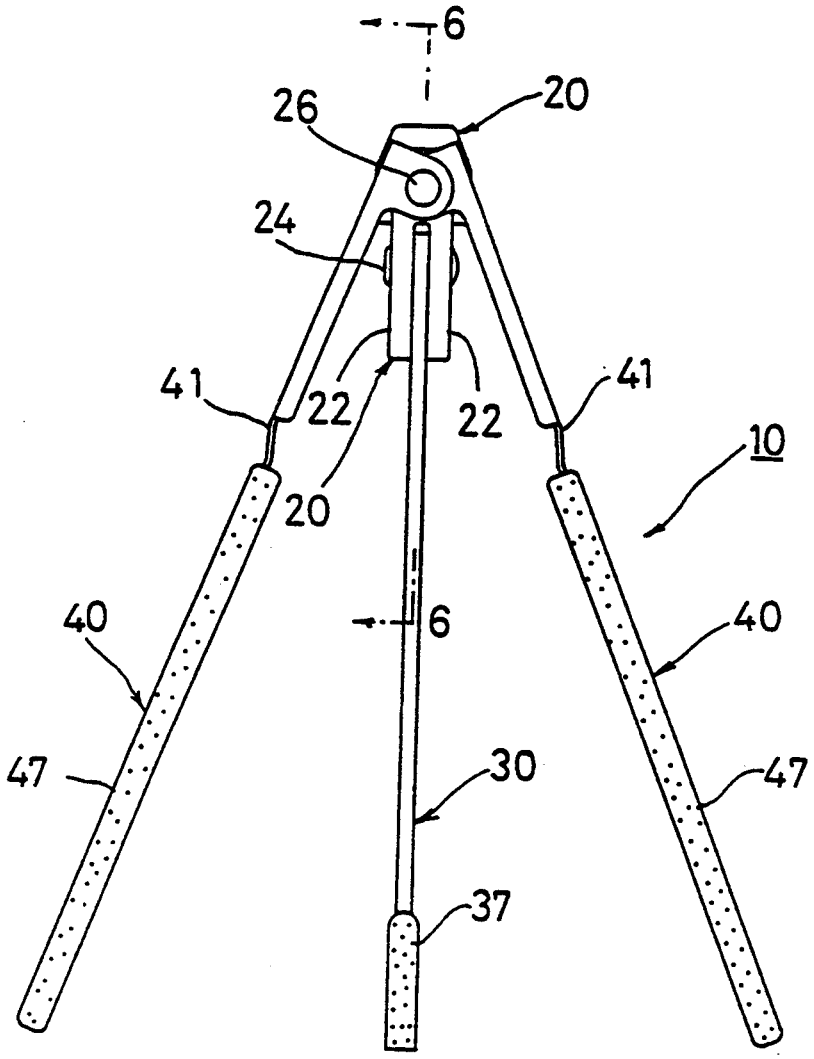
FIG. 2 is a rear view thereof.

As shown in FIGS. 1 and 2, the guitar stand according to the invention comprises a main member 20, a central leg 30 and right and left legs 40 at opposite sides of the central leg along the axis of pivoting of the central leg. A buffer pad 50 on the main member mitigates impact to the guitar. The guitar stand 10 is collapsible compactly such that when it is collapsed, the central leg 30 may approximately fit between the right and left legs 40 which are closed together. As illustrated, the entire length or height of the stand when collapsed is approximately 30 cm, so that it can easily be accommodated inside the pocket of a guitar case.

As shown in FIG. 5, the main member 20 comprises a main body 21 and two fork members 22, which extend downward from the main body 21.

As seen in FIGS. 1 and 3, the central leg 30 is bent off to a small extent to define the shape of an L. Its bent off upper portion is sandwiched between the fork members 22 of the main body 21. It is supported to freely pivot toward either of the front and rear directions of the guitar stand 10 on a pivot shaft 24 which is supported in the main body 21 along a left to right axis. The leg 30 has a leg cover made of rubber or sponge, etc.

Figure 6:
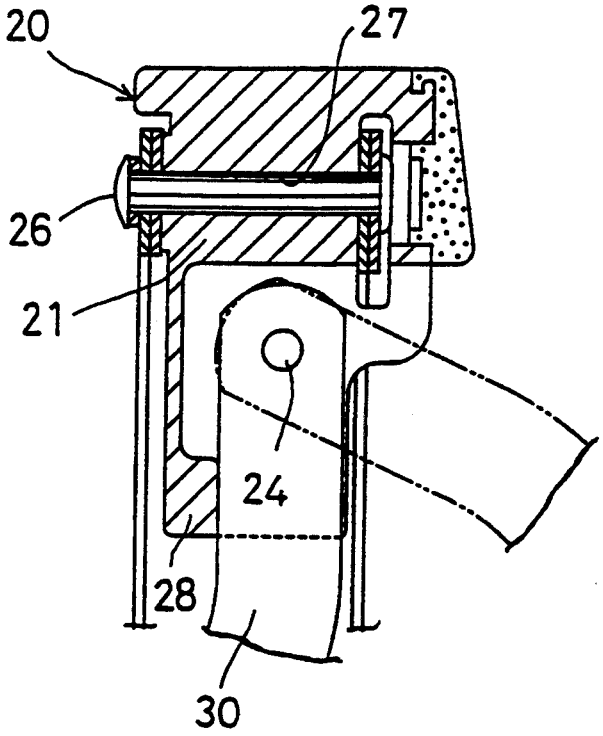
FIG. 6 is a cross section along line 6—6 of FIG. 2.

The swing arc of the rotary movement of the central leg 30 is determined by the size of the stand and the shape of the guitar that is to be supported. As shown in FIG. 6, that swing arc of the central leg 30 in the direction rearwardly of the main member and of the side legs 40 is determined by its contact against a wall 28 formed between the form members 22 of the main body 21. Also, the position of the central leg 30 can be fixed by that wall 28 when the stand has been assembled.

The right and left legs 40 are pivotally supported in the main body 21 on a common pivot shaft 26 along a front to rear axis, i.e., an axis in the direction across the pivot axis 24 of the central leg, so that each leg is freely openable and closable in the right and left directions. The shaft 26 is received in an axial hole in the main body 21.

Each of the right and left legs 40 comprises a main leg body 41 which is approximately in the shape of an L. The body 41 includes a lower guitar holding part 43, which is bent toward the front of the stand. It includes an upper part 42 which is freely pivotably fixed to the main body 21. Each leg 40 is to freely openable away from and closeable toward the other legs in the right and left directions. The shaft 26 received in an axial hole 27 formed in the main member 20 supports the leg parts 42.

Figure 7:
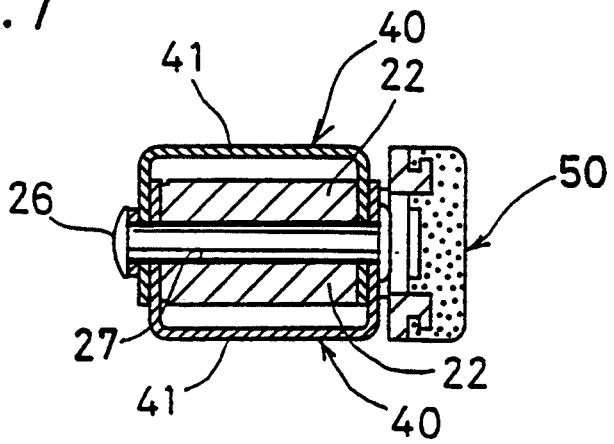
FIG. 7 is a cross section of the guitar stand shown in FIG. 1, along line 7—7 of FIG. 1.

The main leg body 41 may have a cross sectional U-shape, as shown in FIG. 7, for increasing the stability of the guitar that is held and the strength of the stand.

A buffer member 47, such as sponge, etc. is installed on the surface of the guitar holding part 43 to prevent any damage as the guitar and stand contact.

It is desirable to set an open angle between the left and right legs to ensure the greatest stability considering the size of the stand and the weight and shape of the guitar that is to be held. As shown in FIG. 5, a generally umbrella shaped part 15 at the top 29 of the main body 21 has a lower edge 16 which determines the opened angle between the open legs 40 and maintains the open positions of the legs.

The collapsible guitar stand of the invention has a high level of stability when the guitar is placed against it and is capable of being collapsed compactly for being carried around easily.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A collapsible support stand comprising:

a main member;

a central leg in first pivot for pivotally supporting the central leg to the main member for the leg to pivot forward and rearward around a first axis at the main member;

opposite left and right side legs respectively at the opposite sides of the central leg aligned with the first axis, the first pivot being disposed between the left and right side legs; a common second pivot for pivotally supporting the left and right side legs to the main member for the side legs to pivot left and right outward away from each other and from the central leg and inward toward each other, the common second pivot for the left and right side legs being along a second axis across the direction of the first axis;

whereby the stand may be erected for support by pivoting the left and right legs outward away from the central leg and by pivoting the central leg rearward around the first axis;

each of the left and right side legs being generally L-shaped for defining one respective part of the L bent forwardly for supporting an object on the forwardly bent part when the left and right side legs are pivoted outward.

2. The stand of claim 1, wherein the stand provides a support for a guitar and the left and right side legs each include a part thereon for supporting a guitar.

3. The stand of claim 1, wherein the main member has an upper part, the left and right side legs being pivotably mounted to the upper part of the main member, and the central leg also being pivotably mounted to the upper part of the main member.

4. The stand of claim 3, wherein the central leg is shaped and is pivotable with respect to the main member so that the central leg approximately fits between the right and left side legs, when the central leg is pivoted to a position between the right and left side legs and with the right and left side legs pivoted inward toward each other.

5. The stand of claim 4, further comprising first means on the main member for restricting the extent to which the central leg may pivot outward with respect to the main member when the central leg is moved to the stand opened, object supporting position.

6. The stand of claim 5, further comprising second means on the main member for restricting the extent to which the right and left side legs may pivot outward with respect to the main member when the right and left side legs are moved to the stand opened, object supporting position.

7. The stand of claim 5, further comprising a buffer pad at the upper part of the main member on the side thereof facing forward and above the respective forwardly parts of the side legs for buffering contact with the object supported.

8. The stand of claim 3, further comprising a buffer pad at the upper part of the main member on the side thereof facing forward and above the respective forwardly parts of the side legs for buffering contact with the object supported.

9. The stand of claim 1, further comprising first means on the main member for restricting the extent to which the central leg may pivot outward with respect to the main member when the central leg is moved to the stand opened, object supporting position.

10. The stand of claim 1, further comprising first means on the main member for restricting the extent to which the right and left side legs may pivot outward with respect to the main member when the right and left side legs are moved to the stand opened, object supporting position.

11. The stand of claim 10, further comprising second means on the main member for restricting the extent to which the central leg may pivot outward with respect to the main member when the central leg is moved to the stand opened, object supporting position.

* * * * *